US006547633B2

(12) United States Patent
Haug

(10) Patent No.: US 6,547,633 B2
(45) Date of Patent: Apr. 15, 2003

(54) METHOD OF CLOSING A STUFFED TOY

(76) Inventor: Jill A. Haug, 3 Broadway Ct., Lambertville, NJ (US) 08530

( * ) Notice: Subject to any disclaimer, the term of this patent is extended or adjusted under 35 U.S.C. 154(b) by 0 days.

(21) Appl. No.: 10/134,309

(22) Filed: Apr. 26, 2002

(65) Prior Publication Data

US 2003/0027487 A1 Feb. 6, 2003

Related U.S. Application Data

(63) Continuation-in-part of application No. 09/922,882, filed on Aug. 6, 2001, now abandoned.

(51) Int. Cl.[7] ..... A63H 3/02; D05B 97/00
(52) U.S. Cl. ..... 446/369; 112/475.08
(58) Field of Search ..... 446/369, 370, 446/371, 372; 53/452, 469; 112/475.08, 475.17

(56) References Cited

U.S. PATENT DOCUMENTS

| | | | | |
|---|---|---|---|---|
| 371,751 | A | 10/1887 | Fletcher | |
| 1,630,165 | A | 5/1927 | Butler | |
| 2,222,996 | A | 11/1940 | Armstrong | 43/3 |
| 2,347,405 | A | 4/1944 | Ford | 46/151 |
| 3,038,283 | A | 6/1962 | Unger | 493/189 |
| 3,902,456 | A | 9/1975 | David | 119/1 |
| 4,763,369 | A | 8/1988 | Spector | 446/369 |
| 4,781,648 | A * | 11/1988 | Garfinkel | 446/321 |
| 5,141,466 | A | 8/1992 | Catizone | 446/391 |
| 5,182,844 | A | 2/1993 | Honda | 29/469 |
| 5,421,761 | A | 6/1995 | Pitcher et al. | 446/369 |
| 5,885,128 | A * | 3/1999 | Blaustein et al. | 446/369 |
| 6,048,248 | A | 4/2000 | Ritchey | 446/71 |
| 6,109,196 | A | 8/2000 | Silber | 112/475.08 |

* cited by examiner

*Primary Examiner*—Jacob K. Ackun
(74) *Attorney, Agent, or Firm*—Roberts & Mercanti, LLP

(57) ABSTRACT

A stuffed toy formed by providing stuffable toy shell having several fabric members fastened together, thereby defining a container which encloses an interior chamber and which has an exterior surface defining a shape of a toy. The container has an opening which extends through the container material, and is in communication with the interior chamber. A drawstring is stitched around the opening such that the drawstring may be tightened to thereby close the opening. After inserting a stuffing material into the interior chamber of the container through the opening, the drawstring is tightened to close the opening and retain the stuffing in the interior chamber of the container. The closed may opening form a puckered seam which resembles a navel, a scar or other characteristic feature in appearance. The method is generically applicable to doll making.

20 Claims, 3 Drawing Sheets

FIG. 1 – Prior Art

FIG. 2 – Prior Art

METHOD OF CLOSING A STUFFED TOY

CROSS REFERENCE TO RELATED APPLICATION

This application is a continuation-in-part of U.S. patent application Ser. No. 09/922,882 filed Aug. 6, 2001, and now abandoned, which is incorporated herein by reference.

BACKGROUND OF THE INVENTION

1. Field of the Invention

The present invention relates to stuffed toys. More particularly, the invention relates to a method of closing a stuffed toy or doll which employs a thin drawstring or filament sewn around an opening through which the toy is stuffed.

2. Description of the Related Art

Stuffed toys are very popular among children as playthings and adults as collectibles. They typically include a soft inner material or stuffing such as foam which is held within an outer fabric shell or skin which has simulated fur. Commonly, the outer fabric resembles the shape of an animal such as a dog with a body, legs, tail and a head. Their soft physical quality and generally appealing appearance of these stuffed toys bring enjoyment and comfort to their owners.

Most stuffed toys are manufactured by first sewing a fabric shell together from multiple pieces of fabric. The fabric pieces are sewn together inside out, and then turned right side out so that the unsightly edges of the fabric seams remain on the inside of the shell. Typically, an opening is left in the fabric through which stuffing may later be inserted into the shell. A benefit of this practice is that such unstuffed toy shells can be shipped less expensively, since they are lighter and take up less space. These toy shells are also suited for "do it yourself" retail sales. After stuffing, such toys are typically sewn shut. It is also known in the art to pre-stitch the opening prior to stuffing the toy shell. U.S. Pat. No. 6,109,196 discloses such a method, whereby a filament is crisscrossed loosely across an opening of a toy shell as shown in FIG. 2. An injection tube of a stuffing apparatus is inserted into the opening between adjacent loops of the filament, and stuffing material is injected into the interior volume of the container. The injection tube is then withdrawn and the filament is tightened to close the opening. However, this method suffers from a major disadvantage in that the filament may be pushed into the opening and become tangled up with the stuffing, particularly during hand stuffing. Mistakes made during fabrication of such stuffed toys leads to lower production rates and higher processing costs.

It would therefore be desirable to devise a method for forming a stuffed toy includes pre-fabrication of a stuffable toy shell having a pre-stitched opening that can be quickly and easily stuffed and closed without the risk of tangled filaments.

The present invention provides a solution to this problem. The invention includes a stuffed toy formed by providing a stuffable toy shell having several fabric members fastened together, thereby defining a container which encloses an interior chamber and which has an exterior surface defining a shape of a toy. The container has an opening which extends through the container material, and is in communication with the interior chamber. A thin drawstring such as a filament or thread, having a pair of ends, is stitched around the outer periphery of the opening such that the thread may be tightened to thereby close the opening. After inserting a stuffing material into the interior chamber of the container through the opening, the thread is tightened to close the opening and retain the stuffing in the interior chamber of the container.

The thread closure offers a distinct advantage since there are no strings which crisscross the open seam. This method is useful for various stuffing methods, including machine stuffing and hand stuffing. The method of the invention is generically useful for toy and doll making.

SUMMARY OF THE INVENTION

The invention provides a method for forming a stuffed toy which comprises:

a) providing a stuffable toy shell which comprises
   i) a plurality of fabric members fastened together so as to define a container which encloses an interior chamber and which has an exterior surface defining a shape of a toy, the container further comprising an opening through the container in communication with said interior chamber; and
   ii) a drawstring having a pair of ends, which drawstring is stitched around the opening such that the drawstring may be tightened to thereby close the opening;
b) inserting stuffing material into the interior chamber of the container through the opening; and
c) tightening the drawstring to close the opening, thereby retaining the stuffing in the interior chamber of the container.

The invention also provides a stuffable article shell which comprises:

i) a plurality of fabric members fastened together so as to define a container which encloses an interior chamber and which has an exterior surface defining a shape of a toy, the container further comprising an opening through the container in communication with said interior chamber; and
ii) a drawstring having a pair of ends, which drawstring is stitched around the opening such that the drawstring may be tightened to thereby close the opening and retain the stuffing in the interior chamber.

The invention further provides a method for making a stuffed toy, comprising the steps of:

a) fastening together a plurality of fabric members so as to define a container which encloses an interior chamber and which has an exterior surface defining a shape of a toy, the container further comprising an opening through the container in communication with said interior chamber;
b) stitching a drawstring, having a pair of ends, around the opening such that the drawstring may be tightened to thereby close the opening;
c) providing a stuffing apparatus having an injection tube and means for propelling a stuffing material through said tube;
d) inserting the injection tube into the opening of the container;
e) inserting stuffing material into the interior chamber of the container through said injection tube;
f) withdrawing the injection tube from the opening; and
g) tightening the drawstring to close the opening, thereby retaining the stuffing in the interior chamber of the container.

DETAILED DESCRIPTION OF THE PREFERRED EMBODIMENT

The invention relates to a method for forming a stuffed plush toy or doll such as a stuffed animal. The first step of according to the invention includes providing a stuffable toy shell. Such toy shells are well known in the art, and may fabricated or purchased commercially. Typically, such toy shells are fabricated by fastening together a plurality of fabric members, thereby defining a container which encloses an interior chamber and which has an exterior surface defining a shape of a toy. The fabric members may comprise any suitable material, preferably a soft material such that the exterior surface of the stuffable toy would be appealing to the user. The fabric members preferably comprise a material having at least one surface which comprises fur or a fur-like material. The fabric members may be fastened together using any suitable method known in the art, such as sewing and the like.

Figure 1:
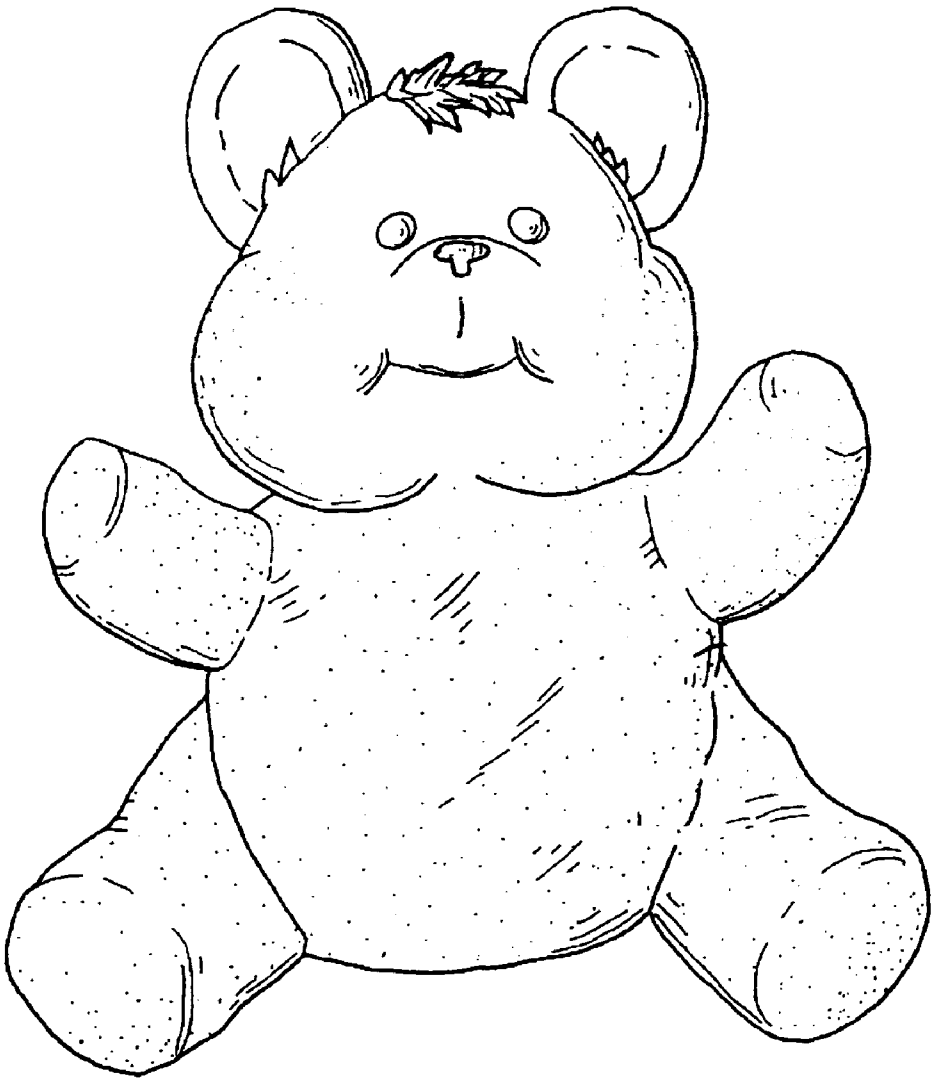
FIG. 1 shows a front view of a prior art stuffed toy.
Figure 2:
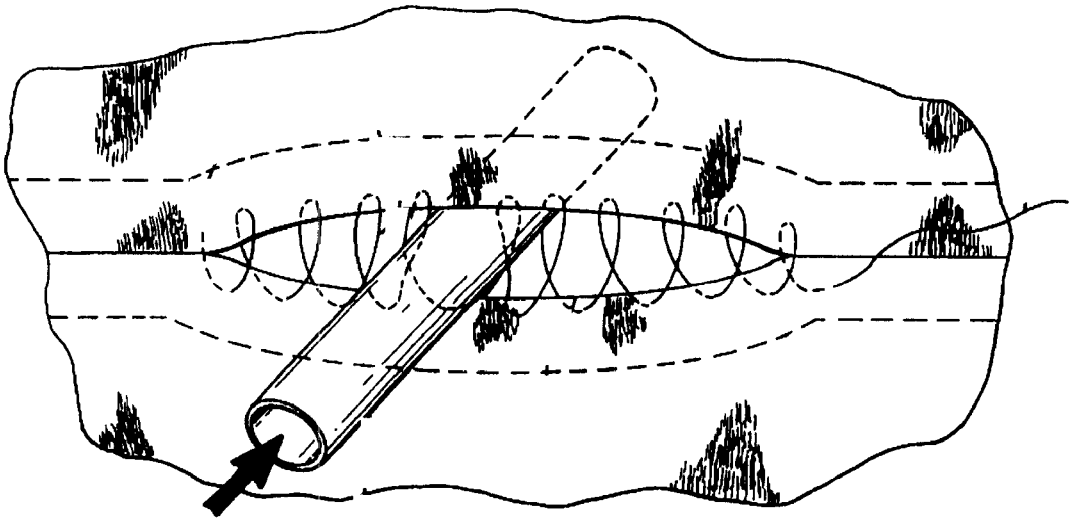
FIG. 2 shows a cut-away view of a prior art method of closing a stuffed toy.

The toy is preferably shaped in the form of an animal such as a teddy bear or the like as shown in FIG. 1. It is also known in the art to pre-stitch the opening prior to stuffing the toy shell. FIG. 2 shows a prior art method, whereby a filament is crisscrossed loosely across an opening of a toy. An injection tube of a stuffing apparatus is inserted into the opening between adjacent loops of the filament, and stuffing material is injected into the interior volume of the container in the direction of the arrow.

Figure 3:
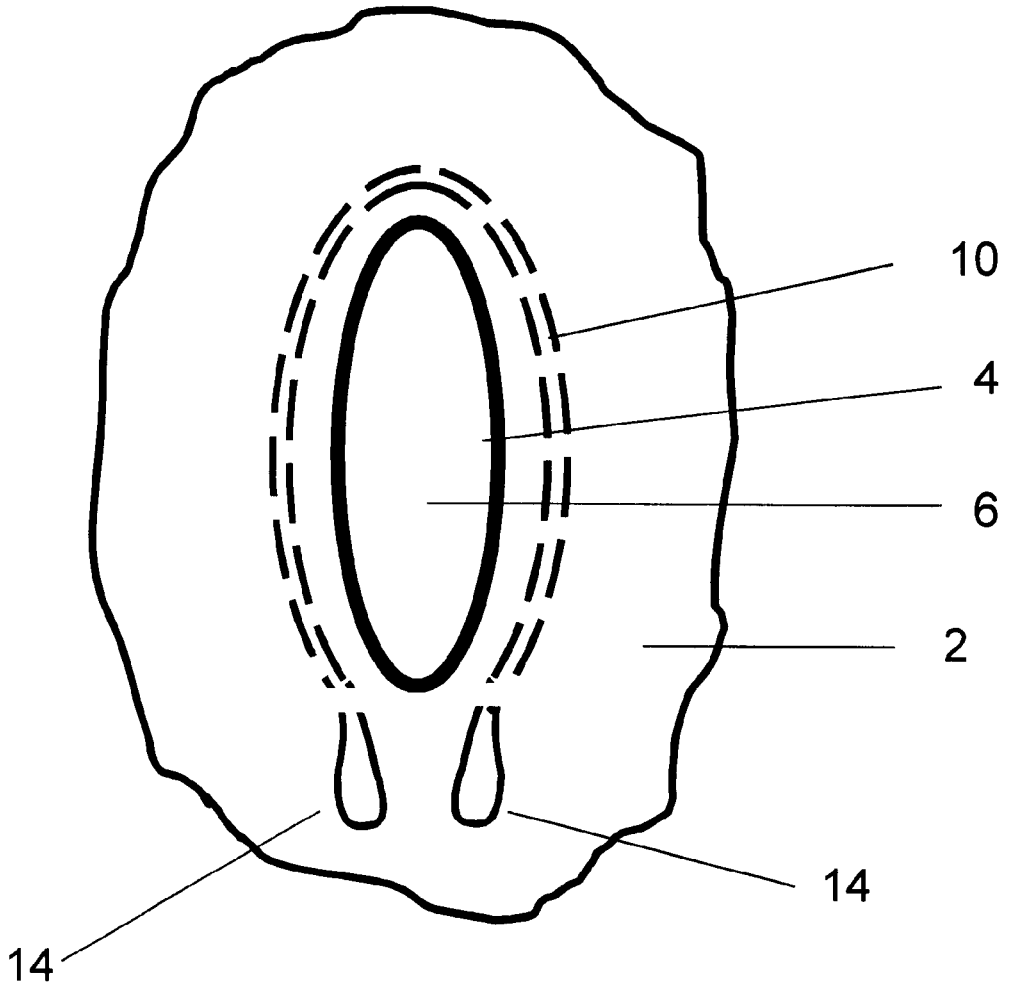
FIG. 3 shows a cut-away view of a stuffable toy shell according to the invention having an opening, and a drawstring stitched around the opening.

FIG. 3 shows a cut-away view of an opening for stuffing a toy shell container according to the present invention. As shown in FIG. 3, the container 2 comprises an opening 4 extending through the fabric members of the container. The opening 4 is in communication with the interior chamber 6 of the container 2. The opening 4 serves to allow the entry of a stuffing material or other material into the interior chamber 6 of the container 2. The opening may be present at any suitable functional or aesthetic location on the toy shell. In one embodiment of the invention, where the toy shell is in the form of an animal, the opening is located at the front side of the toy shell, or on stuffed animal's stomach. In another embodiment, the opening is located at the back side of the toy shell, or on the stuffed animal's back.

FIG. 3 also shows a drawstring 10 having a pair of ends 14, which drawstring 10 is stitched around the opening 4 such that the drawstring 10 may be tightened to thereby close the opening 4. Preferably, the drawstring is stitched around the opening 4 such that the ends 14 of the drawstring 10 extend out of the container 2, such that the ends 14 may be pulled to thereby tighten the drawstring and close the opening 4. It is desirable that the drawstring be stitched around the periphery of opening 4 and not cross from one side of the opening 4 to the other since the latter arrangement would tend to interfere with the stuffing operation. The drawstring may comprise a single-stranded drawstring or a multiple-stranded drawstring. The ends 14 of the drawstring may comprise any form, such as a loop or knot or the like, which may be easily pulled by the fingers to thereby tighten the drawstring and close the opening 4. In one preferred embodiment, shown in FIG. 3, a double-stranded drawstring is stitched around the opening 4 such that the ends 14 each comprise a loop which may be pulled to thereby tighten the drawstring and close the opening 4. The drawstring may comprise any suitable material such as nylon.

According to the invention, a stuffing material is inserted into the interior chamber of the container through the opening. Insertion of the stuffing may be performed using any suitable method known in the art. In one preferred embodiment, the stuffing material is inserted into the interior chamber of the container through the opening by hand. In another preferred embodiment, the stuffing is inserted into the interior chamber of the container via a stuffing apparatus. In another preferred embodiment, a stuffing apparatus is provided which comprises an injection tube and means for propelling a stuffing material through said tube. The injection tube is inserted into the opening of the container, and stuffing material is propelled through the injection tube and into the interior chamber of the container. The injection tube is then withdrawn from the opening. Suitable stuffing materials nonexclusively include polyester-cellulose fibers, polystyrene beads, polymeric material such as polyurethane, shredded textile material, shredded vegetable material, and combinations thereof.

After stuffing, the drawstring is then tightened to close the opening, thereby retaining the stuffing in the interior chamber of the container. Preferably, the closed opening forms a puckered seam which seals off the interior chamber and prevents the stuffing from escaping from the container. The puckered seam may optionally form an aesthetic feature of the stuffed toy, such as a belly button or scar or the like.

The drawstring may then be cut, tied, knotted, fastened, clipped, or the like, to temporarily or permanently prevent the closed opening from re-opening. Optionally but preferably, both ends of the drawstring are tied off. In a preferred embodiment, the drawstring is tied off flush with the exterior surface of the container.

The stuffed toys formed according to the present invention may be sold at the location where they are sold, or shipped elsewhere for subsequent stuffing.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A method for forming a stuffed toy which comprises:

a) providing a stuffable toy shell which comprises i) a plurality of fabric members fastened together so as to define a container which encloses an interior chamber and which has an exterior surface defining a shape of a toy, the container further comprising an opening through the container in communication with said interior chamber; and ii) a drawstring having a pair of ends, which drawstring comprises a line of stitching stitched through the fabric and across portions of upper and lower surfaces of the fabric in a direction extending around the periphery of the opening without extending across the opening, such that the drawstring may be tightened to thereby close the opening;

b) inserting stuffing material into the interior chamber of the container through the opening; and c) tightening the drawstring to close the opening, thereby retaining the stuffing in the interior chamber of the container.

2. The method of claim 1, wherein each end of the drawstring comprises a loop.

3. The method of claim 1, wherein each end of the drawstring comprises a knot.

4. The method of claim 1, further comprising the subsequent step of tying off said drawstring flush with said exterior surface.

5. The method of claim 1 wherein the closed opening forms a puckered seam.

6. The method of claim 1, wherein the stuffing material is inserted into the interior chamber by hand.

7. The method of claim 1 wherein the stuffing material is inserted into said interior chamber of said container by a providing a stuffing apparatus comprising an injection tube and means for propelling a stuffing material through said tube; inserting said injection tube into said opening; and propelling the stuffing material into the interior chamber through said injection tube.

8. The method of claim 1 wherein the stuffing material is a selected from the group consisting of polyester-cellulose fibers, polystyrene beads, polymeric material, shredded textile material, shredded vegetable material, and combinations thereof.

9. The method of claim 1 wherein the drawstring comprises nylon.

10. A stuffable article shell which comprises:

i) a plurality of fabric members fastened together so as to define a container which encloses an interior chamber and which has an exterior surface defining a shape of a toy, the container further comprising an opening through the container in communication with said interior chamber, and ii) a drawstring having a pair of ends, which drawstring comprises a line of stitching stitched through the fabric and across portions of upper and lower surfaces of the fabric in a direction extending around the periphery of the opening without extending across the opening, such that the drawstring may be tightened to thereby close the opening.

11. The shell of claim 10, wherein each end of the drawstring comprises a loop.

12. The shell of claim 10, wherein each end of the drawstring comprises a knot.

13. A method for making a stuffed toy, comprising the steps of:

a) fastening together a plurality of fabric members so as to define a container which encloses an interior chamber and which has an exterior surface defining a shape of a toy, the container further comprising an opening through the container in communication with said interior chamber;

b) stitching a drawstring, having a pair of ends, which drawstring comprises a line of stitching stitched through the fabric and across portions of upper and lower surfaces of the fabric in a direction extending around the periphery of the opening without extending across the opening, such that the drawstring may be tightened to thereby close the opening;

c) providing a stuffing apparatus having an injection tube and means for propelling a stuffing material through said tube;

d) inserting the injection tube into the opening of the container;

e) inserting stuffing material into the interior chamber of the container through said injection tube;

f) withdrawing the injection tube from the opening; and g) tightening the drawstring to close the opening, thereby retaining the stuffing in the interior chamber of the container.

14. The method of claim 13, wherein each end of the drawstring comprises a loop.

15. The method of claim 13, wherein each end of the drawstring comprises a knot.

16. The method of claim 13, further comprising the subsequent step of tying off both ends of said drawstring flush with said exterior surface.

17. The method of claim 13 wherein the closed opening forms a puckered seam.

18. The method of claim 13, wherein the stuffing material is inserted into the interior chamber by hand.

19. The method of claim 13 wherein the stuffing material is inserted into said interior chamber of said container by a providing a stuffing apparatus comprising an injection tube and means for propelling a stuffing material through said tube; inserting said injection tube into said opening; and propelling the stuffing material into the interior chamber through said injection tube.

20. The method of claim 13 wherein the stuffing material is a selected from the group consisting of polyester-cellulose fibers, polystyrene beads, polymeric material, shredded textile material, shredded vegetable material, and combinations thereof.

* * * * *